US007726859B2

(12) United States Patent
Naganawa et al.

(10) Patent No.: US 7,726,859 B2
(45) Date of Patent: Jun. 1, 2010

(54) LAMP UNIT OF VEHICULAR HEADLAMP

(75) Inventors: Masahito Naganawa, Shizuoka (JP); Motohiro Komatsu, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 271 days.

(21) Appl. No.: 12/044,187

(22) Filed: Mar. 7, 2008

(65) Prior Publication Data

US 2008/0239745 A1 Oct. 2, 2008

(30) Foreign Application Priority Data

Mar. 29, 2007 (JP) ..... 2007-088538

(51) Int. Cl.
*F21V 11/00* (2006.01)

(52) U.S. Cl. ..... 362/539; 362/516; 362/520; 362/297; 362/308

(58) Field of Classification Search ..... 362/516–520, 362/296.01, 296.05, 297, 307–308, 538–539, 362/346, 341
See application file for complete search history.

(56) References Cited

U.S. PATENT DOCUMENTS 6,948,836 B2 * 9/2005 Ishida et al. ..... 362/516
2007/0201241 A1 * 8/2007 Komatsu ..... 362/545

FOREIGN PATENT DOCUMENTS

JP 2005-235707 A 9/2005

OTHER PUBLICATIONS

English abstract of JP2005235707 published Sep. 2, 2005, esp@cenet database, 1 page.

* cited by examiner

*Primary Examiner*—Jong-Suk (James) Lee
*Assistant Examiner*—Robert J. May
(74) *Attorney, Agent, or Firm*—Osha • Liang LLP

(57) ABSTRACT

A lamp unit of a vehicular headlamp includes a projection lens with an optical axis; a light source formed from a semiconductor light-emitting element; a first reflector that reflects light from the light source so as to condense such light on or near the optical axis; and a shade positioned between the light source and the projection lens so as to extend along the optical axis direction. The shade shields part of the light reflected by the first reflector. In the lamp unit of the vehicular headlamp, a shielding surface extends rearward from a front end of the shade, where the shade is positioned near a rearward focal point Rf of the projection lens. The shielding surfaces serve as a second reflector that reflects light from the first reflector toward the projection lens. In addition, a transparent portion is formed on part of the second reflector such that part of the light reflected by the first reflector passes downward of the rearward focal point of the projection lens and is then incident to the projection lens.

16 Claims, 3 Drawing Sheets

LAMP UNIT OF VEHICULAR HEADLAMP

BACKGROUND OF INVENTION

1. Field of the Invention

The present invention relates to a novel lamp unit of a vehicular headlamp. More specifically, the present invention relates to radiating light for viewing an overhead sign above a road (referred to as an overhead sign below) using part of headlamp light.

2. Related Art

A low-beam of a headlamp of a vehicle such as an automobile is strongly suppressed such that upward diffusion light is not generated, in order to ensure that dazzling light is not radiated to drivers of preceding vehicles, pedestrians, and the like. Therefore, little light reaches an upper side of a cut-off line limiting an upper end edge.

Meanwhile, in current transportation conditions, overhead signs are used to display a branch direction of a road, a distance to a major location, and the like. The overhead signs are formed from a highly reflective material to improve visibility. However, a low-beam with good performance radiates little light above the cut-off line. Therefore, there is a risk that the overhead sign may be missed.

Headlamps such as the vehicular headlamp disclosed in Patent Document 1 have been proposed that provide desired light distribution by collecting a plurality of so-called projector type lamp units. In the lamp units, a semiconductor light-emitting element such as a light-emitting diode (referred to as an LED below) is used as a light source. The light of the semiconductor light-emitting element is condensed by a reflector and part of the condensed light is shielded in the forward direction by a shade. In addition, the condensed light, which is partially shielded, is inverted and radiated forward by a projection lens with a rearward focal point in the condensed light region.

According to the lamp unit of the vehicular headlamp disclosed in Patent Document 1, the shade is disposed generally along an optical axis of the projection lens, and an upper surface of the shade is formed as a reflective surface. Light which reaches the reflective surface from the reflector is incident to the projection lens. In this manner, efficient use of the light from the light source is achieved. Accordingly, no light passes downward from a rearward focal point of the projection lens and reaches the projection lens. Therefore, no light heads toward an upper side of the cut-off line, resulting in no light for viewing the overhead sign.

According to the lamp unit of the vehicular headlamp disclosed in Patent Document 2, the shade has a window portion that is provided below the rearward focal point of the projection lens. Direct light from the LED passes through the window portion, reaches the projection lens, and illuminates a so-called overhead zone above the cut-off line. In this manner, it is possible to view the overhead sign.

[Patent Document 1] U.S. Pat. No. 6,948,836 B2

[Patent Document 2] Japanese Patent Application Laid-Open (Kokai) No. 2005-235707

SUMMARY OF INVENTION

However, according to the lamp unit of the vehicular headlamp disclosed in Patent Document 2, given current LED technology, in view of the narrow light-emitting area of the LED, it is extremely difficult to use part of the direct light from the LED to illuminate the overhead zone with a structure as shown in FIG. 10 of Patent Document 2. If the direct light from the LED is incident to the projection lens from the window portion of the shade as shown in FIG. 10 of Patent Document 2, the LED must be tilted forward at an extremely steep angle. In this case, the amount of light toward an essential light distribution portion of the headlamp may be reduced.

One or more embodiments of the prevent invention enable light distribution above a cut-off line using a currently available LED as a light source, without reducing an amount of light toward an essential portion of headlamp light distribution.

In one or more embodiments, a lamp unit of a vehicular headlamp includes: a projection lens with an optical axis; a light source formed from a semiconductor light-emitting element; a first reflector which reflects light from the light source so as to condense such light on the optical axis or in the vicinity thereof; and a shade that is positioned between the light source and the projection lens so as to extend along the optical axis direction and shields part of the light reflected by the first reflector. In the lamp unit of the vehicular headlamp, a shielding surface extending rearward from a front end of the shade, wherein the shade is positioned in the vicinity of a rearward focal point of the projection lens, serves as a second reflector that reflects light from the first reflector toward the projection lens. In addition, a light transparency portion is formed on part of the second reflector such that part of the light reflected by the first reflector passes downward of the rearward focal point of the projection lens and is then incident to the projection lens.

According to the lamp unit of the vehicular headlamp of one or more embodiments of the present invention, it is possible to distribute the minimum required amount of light radiated from the light source above a cut-off line while using a semiconductor light-emitting element such as a currently available LED as the light source. Furthermore, it is possible to minimize a decrease in the amount of light to an essential light distribution portion of the headlamp.

A lamp unit of a vehicular headlamp according to one or more embodiments of the present invention includes: a projection lens with an optical axis; a light source formed from a semiconductor light-emitting element; a first reflector which reflects light from the light source so as to collect such light on the optical axis or in the vicinity thereof, and a shade that is positioned between the light source and the projection lens so as to extend along the optical axis direction and shields part of the light reflected by the first reflector. In the lamp unit of the vehicular headlamp, a shielding surface extending rearward from a front end of the shade, wherein the shade is positioned near a rearward focal point of the projection lens, serves as a second reflector that reflects light from the first reflector toward the projection lens. The lamp unit of the vehicular headlamp is characterized in that a light transparency portion is formed on part of the second reflector such that part of the light reflected by the first reflector passes downward of the rearward focal point of the projection lens and is then incident to the projection lens.

According to the lamp unit of the vehicular headlamp of one or more embodiments of the present invention, it is possible to distribute the minimum required amount of light radiated light from the light source above a cut-off line while using a semiconductor light-emitting element such as a currently available LED as the light source. Furthermore, it is possible to minimize a decrease in the amount of light to an essential light distribution portion of the headlamp.

According to one or more embodiments of the present invention, the shade is formed from a transparent material, the second reflector is formed by a surface treatment such as metal vapor deposition, the light transparent portion is formed without being subjected to the surface treatment. In addition, the light passing through the light transparent portion refracts when incident to the transparent material, proceeds to inside the transparent material, radiates from a light radiation portion formed near the rearward focal point of the projection lens, and is incident to the projection lens. Therefore, it is possible to precisely control a light radiation position for upward light distribution, thus enabling precise control of a position for upward light distribution.

According to one or more embodiments of the present invention, the light radiation portion is positioned downward and rearward from the rearward focal point of the projection lens. Therefore, it is possible to suitably diffuse light for upward light distribution, thus preventing more brightness than necessary from being produced.

Other aspects and advantages of the invention will be apparent from the following description, the drawings and the claims.

DETAILED DESCRIPTION

Figure 1:
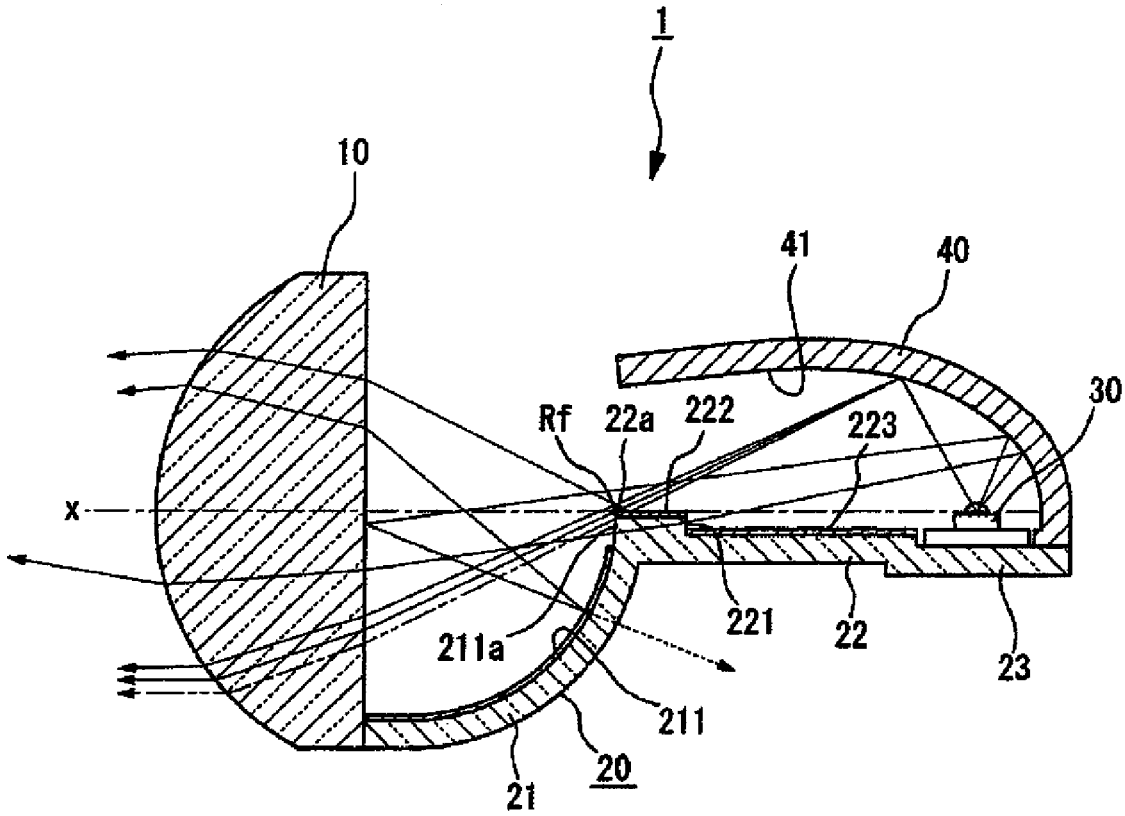
FIG. 1 is a schematically vertical cross-sectional view showing a first embodiment of a lamp unit of a vehicular headlamp according to the present invention.

Hereinafter, embodiments of a lamp unit of a vehicular headlamp according to the present invention will be described with reference to the accompanying drawings. Note that embodiments shown in the drawings apply the present invention to a lamp unit of an automotive headlamp.

FIG. 1 shows a first embodiment of the lamp unit of the vehicular headlamp according to the present invention.

A lamp unit 1 of the automotive headlamp includes a projection lens 10 with an optical axis x. The projection lens 10 is supported by a front end portion of a supporting portion 21 that forms part of a base member 20. The base member 20 is formed integrated with the supporting portion 21, a shade portion 22, and a light source installation portion 23. The respective portions of the base member 20 are integrally formed from a transparent material such as transparent synthetic resin.

The shade portion 22 is formed as a plate-shaped portion generally along the optical axis of the projection lens 10. A stepped surface 221 is formed facing rearward on a portion near a front end of an upper surface portion of the shade portion 22. In addition, a front end 22*a* of the upper surface is positioned in the vicinity of a rearward focal point Rf of the projection lens 10. An upper surface 222 in front of the stepped surface 221 is subjected to a surface treatment such as aluminum vapor deposition to serve as a reflective surface. Furthermore, an upper surface 223 behind the stepped surface 221 is subjected to half vapor deposition to serve as a half mirror surface. A second reflector is structured from the upper surface 222 that serves as a reflective surface and the upper surface 223 that serves as a half mirror surface. In addition, the stepped surface 221 is not subjected to surface treatments such as aluminum vapor deposition and half vapor deposition, and serve as a transparent portion.

The supporting portion 21 curves and extends in a diagonally downward and upward direction from a front end of the shade portion 22 so as to form a concave surface. The front end portion of the supporting portion 21 supports a lower end of the projection lens 10. In addition, an upper surface 211 of the supporting portion 21 is subjected to half vapor deposition to serve as a half mirror surface. A portion 211*a* of the half mirror surface 211 opposite to the transparent portion 221 serves as a light radiation portion. Note that the light radiation portion 211*a* need not be subjected to half vapor deposition and may remain a transparent surface.

The light source installation portion 23 extends further rearward from a rear end of the shade portion 22. On an upper surface of the light source installation portion 23, a semiconductor light-emitting element such as an LED 30, i.e., a light source, is positioned facing generally upward.

A first reflector 40 is disposed so as to practically cover over the shade portion and the light source installation portion 23 of the base member 20. The first reflector 40 includes a reflective surface 41, which reflects direct light from the LED 30 toward the second reflector (structured from the upper surfaces 222, 223), and condenses most of such light in the vicinity of the front end of the shade portion 22.

Figure 2:
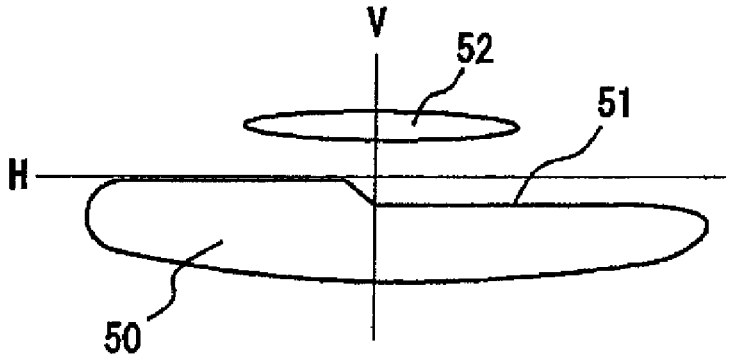
FIG. 2 is a schematic view showing an example of a light distribution pattern of a beam formed by the lamp unit of the vehicular headlamp according to the present invention.

In the lamp unit 1 of the automotive headlamp described above, most of the light radiated from the LED 30 is reflected by the reflective surface 41 of the first reflector 40 and condensed in the vicinity of the rearward focal point Rf of the projection lens 10. In addition, light reflected by the reflective surface 41 and headed toward the second reflector (structured from the upper surfaces 222, 223) is reflected therefrom and becomes incident to a rear surface of the projection lens 10. Regarding light condensed at generally the rearward focal point Rf of the projection lens 10, part of such light is shielded by the shade portion 22 and the remaining light is incident to the rear surface of the projection lens 10 and is radiated roughly parallel to the optical axis x by the projection lens 10. Regarding light reflected by the second reflector (structured from the upper surfaces 222, 223) and incident to the rear surface of the projection lens 10, all such light passes from behind the rearward focal point Rf of the projection lens 10 upward therethrough and is incident to an upper half of the projection lens 10. Accordingly, the light is radiated downward by the projection lens 10. Therefore, a beam with a light distribution 50 shown in FIG. 2 is radiated. The light distribution 50 includes a cut-off line 51 that is limited by the front end 22*a* of the shade portion 22 on an upper end thereof.

Meanwhile, light reflected by the reflective surface 41 of the first reflector 40 and headed toward the stepped surface 221 of the base member 20 is incident to an internal portion of the base member 20 from the stepped surface 221. Note that the light is refracted somewhat upward while passing through the stepped surface 221 and approaches the rearward focal point Rf of the projection lens 10. In addition, the light proceeds forward in the internal portion of the base member 20, radiates from the light radiation portion 211*a* formed on the front surface of the supporting portion 21, and is then incident to a lower half portion of the projection lens 10 rear surface. Furthermore, light passes below the rearward focal point Rf of the projection lens and is incident to the lower half portion of the projection lens 10. Therefore, the light is radiated somewhat upward by the projection lens 10 and illuminates an overhead area 52 that is positioned above the cut-off line in the light distribution 50 shown in FIG. 2. Because the aforementioned overhead sign is positioned in the overhead area 52, the overhead sign is visible. Furthermore, the light headed toward the overhead area 52 passes through a position outside the rearward focal point Rf of the projection lens 10 and is diffusely radiated rather than locally condensed. Therefore, the light has a low intensity and there is no risk of such light acting as diffusion light disturbing others such as drivers of a host vehicle and a preceding vehicle.

Note that, in some cases, light incident to the rear surface of the projection lens 10 may be reflected by the rear surface and directed back to the supporting portion 21 of the base member 20. Most of such light enters from the half mirror surface 211 of the supporting portion 21 to inside the base member 20. Therefore, little light reflected by the front surface of the supporting portion 21 and again radiated forward by the projection lens 10 acts as diffusion light.

The automotive headlamp is structured so as to create a desired light distribution by collecting a plurality of the lamp units 1 of the aforementioned automotive headlamp or a plurality of the lamp units with a different light distribution. However, such a structure is not the aim of the present invention, so details therefor are omitted here.

Figure 3:
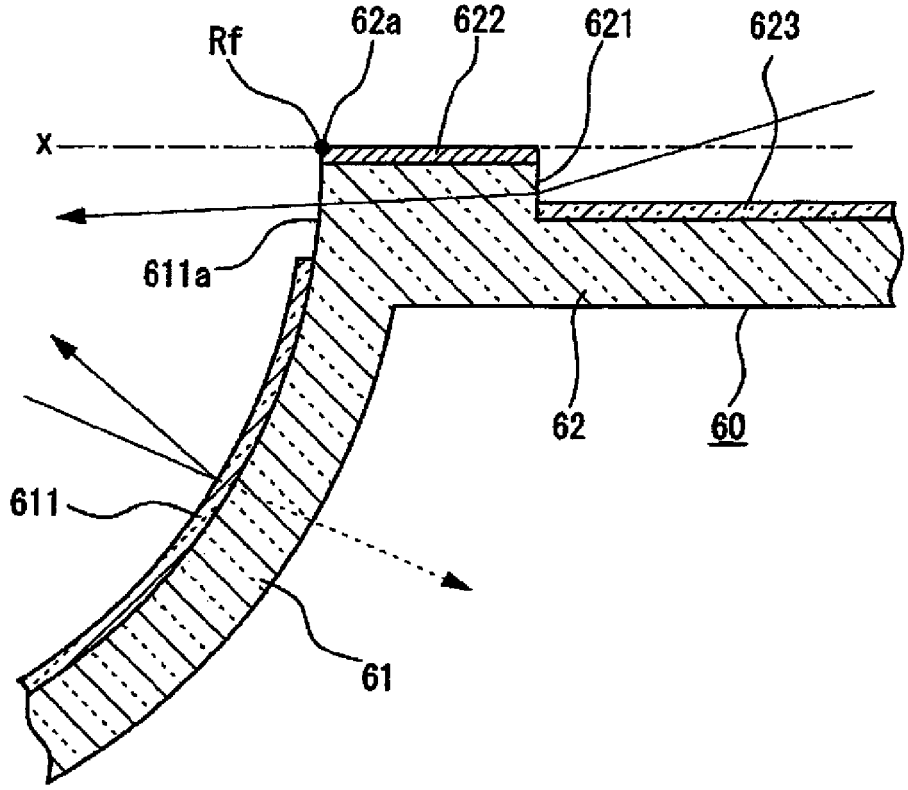
FIG. 3 is a schematically cross-sectional view of an essential portion showing a modification of the first embodiment.

FIG. 3 shows another embodiment of the lamp unit 1 of the automotive headlamp.

The lamp unit 1 of the automotive headlamp shown is an embodiment where light reflected by the first reflector 40 reaches a position relatively rearward of the shade portion 22. The embodiment shown in FIG. 3 is an example in which a condensing characteristic of light reflected by the first reflector 40 is relatively high.

In a shade portion 62 of a base member 60 according to the embodiment shown in FIG. 3, a stepped surface 621 is positioned closer to a front end 62*a* of the shade portion 62 compared to the stepped surface 221 in the earlier-described embodiment. In an upper surface of the shade portion 62, a portion forward of the stepped surface 621 serves as a reflective surface 622 and a portion rearward of the stepped surface 621 serves as a half mirror surface 623. A second reflector is structured from the reflective surface 622 and the half mirror surface 623. In addition, the stepped surface 621 is not subjected to reflection treatment, half vapor deposition, or the like, and serves as a transparent portion.

A supporting portion 61 curves and extends in a diagonally downward and upward direction from a front end of the shade portion 62 so as to form a concave surface. The front end portion of the supporting portion 61 supports the lower end of the projection lens. In addition, an upper surface 611 of the supporting portion 61 is subjected to half vapor deposition to serve as a half mirror surface. A portion 611*a* of the half mirror surface 611 opposite to the transparent portion 621 serves as a light radiation portion. Note that the light radiation portion 611*a* need not be subjected to half vapor deposition and may remain a transparent surface.

According to the embodiment shown in FIG. 3, light relatively near the rearward focal point Rf of the projection lens, among light reflected by the first reflector, is incident from the transparent portion 621 to inside the base member 60, and is radiated from the light radiation portion 611*a* to the projection lens. This contributes to illumination of the overhead area 52.

Figure 4:
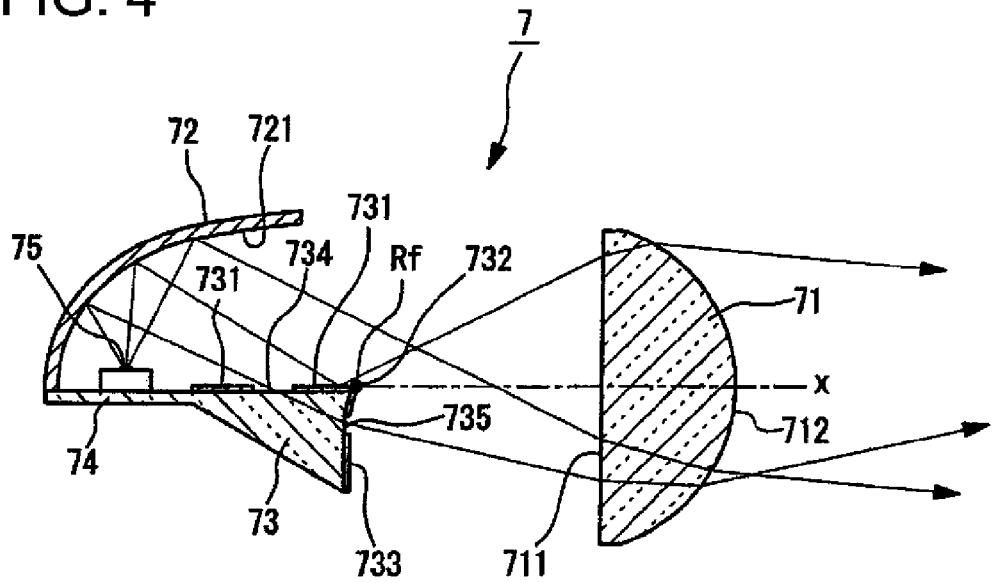
FIG. 4 shows a second embodiment of the lamp unit of the vehicular headlamp according to the present invention together with FIGS. 5 and 6, and is a schematically vertical cross-sectional view.
Figure 5:
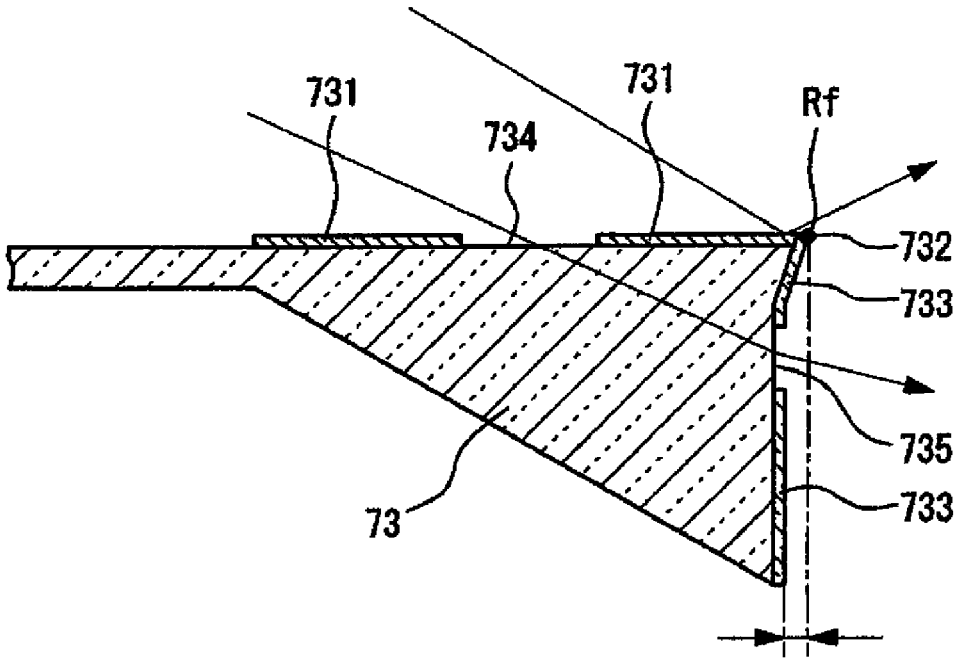
FIG. 5 is an enlarged vertical cross-sectional view of an essential portion.
Figure 6:
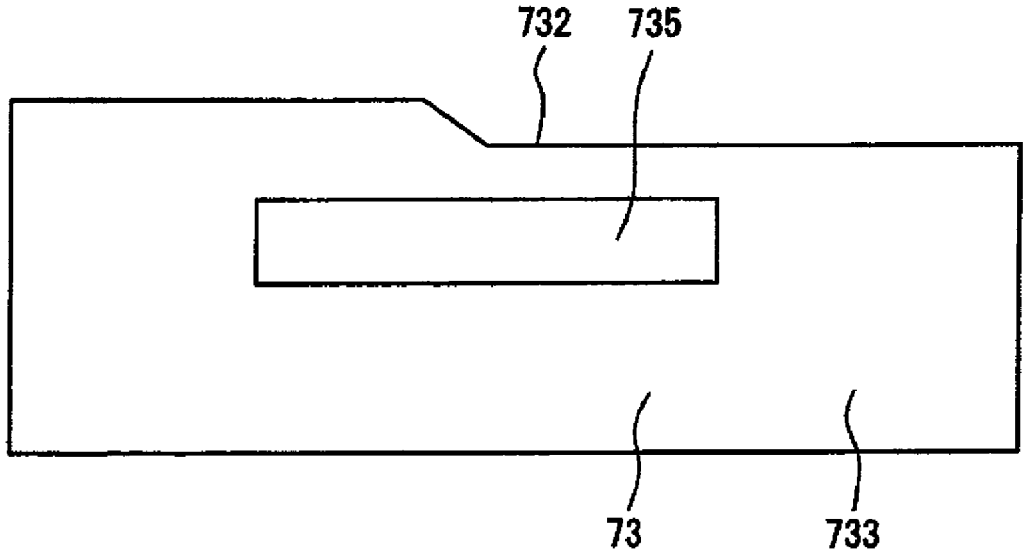
FIG. 6 is an enlarged front view of an essential portion.

FIGS. 4 to 6 show another embodiment of a lamp unit of a vehicular headlamp according to the present invention.

A lamp unit 7 of an automotive headlamp includes a projection lens 71 with an optical axis x. The projection lens 71 is formed into a semispherical shape whose rear surface 711 is a flat plane and whose front surface 712 curves outward in the forward direction.

A first reflector 72 is disposed so as to face opposite to a generally upper half of the projection lens 71. A shade 73 is positioned between the first reflector 72 and the projection lens 71. The shade 73 is formed from a transparent material such as transparent synthetic resin. The shade 73 includes an upper flat plane that extends along an optical axis x of the projection lens 71, on which a reflection film 731 is formed by aluminum vapor deposition or the like, thus structuring a second reflector. An upper end of a front surface of the shade 73 protrudes somewhat forward, namely, toward the projection lens 71. A front end edge 732 on an upper surface of the protrusion portion is a portion for forming a cut-off line as an upper edge of light distribution. In addition, the front surface of the shade portion 73 is subjected to half vapor deposition to serve as a half mirror surface 733. Furthermore, a rearward focal point Rf of the projection lens 71 is positioned in the vicinity of the front end edge 732 of the shade 73.

The reflection film 731 is not formed somewhat rearward from the front end edge 732 on the upper flat plane of the shade 73. Such portion serves as a transparent portion 734. In addition, the half mirror surface 733 is not formed on a portion where light entering from the transparent portion 734 to inside the material of the shade 73 reaches the front surface thereof. Such portion serves as a light radiation portion 735.

A light source installation portion 74 is disposed rearward of the shade 73, and a semiconductor light-emitting element such as an LED 75 is disposed as a light source on the light source installation portion 74. Radiated light from the LED 75 is reflected by a reflective surface 721 of the first reflector 72 and condensed in the vicinity of the front end edge 732 of the shade 73. Part of the condensed light is shielded by the shade 73, while the remaining light is incident to a lower half portion of a rear surface of the projection lens 71 and radiated forward and roughly parallel by the projection lens 71. In addition, light shielded by the shade 73 is reflected by the second reflector 731, incident to an upper half portion of the rear surface 711 of the projection lens 71, and radiated somewhat downward by the projection lens 71. In this manner, a beam with the light distribution 50 shown in FIG. 2 is radiated.

Light reaching the transparent portion 734, among light shielded by the shade 73, is incident to an internal portion of the shade 73 from the transparent portion 734 into an internal portion of the shade 73. The light then proceeds to inside the shade 73, radiates from the light radiation portion 735, and is incident to the lower half portion of the rear surface 711 of the projection lens 71. Furthermore, such light is radiated relatively upward by the projection lens 71 and illuminates the overhead area 52 shown in FIG. 2. Note that, as shown in FIG. 5, the light radiation portion 735, which radiates the light toward the overhead area 52, is positioned downward and rearward from the rearward focal point Rf of the projection lens 71. Accordingly, the light is somewhat diffused and not locally condensed by the projection lens 71. Accordingly, the light has a low intensity and there is no risk of such light acting as the diffusion light disturbing others such as drivers of a host vehicle and a preceding vehicle.

Note that, similar to the earlier embodiments, the half mirror surface 733 of the shade 73 front surface is useful in preventing the formation of diffusion light by secondary reflection.

As described above, according to the lamp unit of the vehicular headlamp of embodiments of the present invention, part of the light reflected by the first reflector is used to illuminate the overhead area. Therefore, it is possible to illuminate the overhead area using a semiconductor light-emitting element with a relatively narrow illumination angle, such as currently available LEDs, without reducing the brightness of a main light distribution.

While description has been made in connection with exemplary embodiments of the present invention, it will be obvious to those skilled in the art that various changes and modification may be made therein without departing from the present invention. It is aimed, therefore, to cover in the appended claims all such changes and modifications falling within the true spirit and scope of the present invention.

DESCRIPTION OF THE REFERENCE NUMERALS

1 LAMP UNIT OF AUTOMOTIVE HEADLAMP (LAMP UNIT OF VEHICULAR HEADLAMP)
10 PROJECTION LENS
x OPTICAL AXIS
Rf REARWARD FOCAL POINT
211*a* LIGHT RADIATION PORTION
22 SHADE PORTION (SHADE)
22*a* FRONT END
221 STEPPED SURFACE (LIGHT TRANSPARENCY PORTION)
222 REFLECTIVE SURFACE
223 HALF MIRROR SURFACE
222, 223 SECOND REFLECTOR
30 LED (LIGHT SOURCE)
40 FIRST REFLECTOR
611*a* LIGHT RADIATION PORTION
62 SHADE PORTION (SHADE)
62*a* FRONT END
621 STEPPED SURFACE (LIGHT TRANSPARENCY PORTION)
622 REFLECTIVE SURFACE
623 HALF MIRROR SURFACE
622, 623 SECOND REFLECTOR
7 LAMP UNIT OF AUTOMOTIVE HEADLAMP (LAMP UNIT OF VEHICULAR HEADLAMP)
71 PROJECTION LENS
x OPTICAL AXIS
Rf REARWARD FOCAL POINT
72 FIRST REFLECTOR
73 SHADE
731 REFLECTION FILM (SECOND REFLECTOR)
732 FRONT END EDGE (FRONT END)
734 LIGHT TRANSPARENCY PORTION
735 LIGHT RADIATION PORTION
75 LED (LIGHT SOURCE)

What is claimed is:

1. A lamp unit of a vehicular headlamp comprising:
a projection lens with an optical axis;
a light source formed from a semiconductor light-emitting element;
a first reflector that reflects light from the light source so as to collect such light on or near the optical axis; and
a shade positioned between the light source and the projection lens so as to extend along a direction of the optical axis,
wherein the shade shields part of the light reflected by the first reflector,
wherein a shielding surface of the shade extends rearward from a front end of the shade, where the shade is positioned near a rearward focal point of the projection lens,
wherein the shielding surface serves as a second reflector that reflects-light from the first reflector toward the projection lens, and
wherein a transparent portion is formed on part of the second reflector such that part of the light reflected by the first reflector passes downward of the rearward focal point of the projection lens and is then incident to the projection lens.

2. The lamp unit of a vehicular headlamp according to claim 1,
wherein the shade is formed from a transparent material,
wherein the second reflector is formed by a surface treatment, and
wherein the transparent portion is formed by not being subjected to the surface treatment,
wherein light passing through the transparent portion refracts when incident to the transparent material of the shade, proceeds inside the transparent material of the shade, radiates from a light radiation portion formed near the rearward focal point of the projection lens, and is then incident to the projection lens.

3. The lamp unit of a vehicular headlamp according to claim 2,
wherein the light radiation portion is positioned downward and rearward from the rearward focal point of the projection lens.

4. The lamp unit of a vehicular headlamp according to claim 2, wherein the surface treatment is metal vapor deposition.

5. A lamp unit of a vehicular headlamp comprising:
a projection lens with an optical axis;
a light source;
a first reflector that reflects light from the light source so as to collect such light on or near the optical axis; and
a shade positioned between the light source and the projection lens so as to extend along a direction of the optical axis,
wherein the shade shields part of the light reflected by the first reflector and the shade comprises:
a shielding surface extending rearward from a front end of the shade, where the shade is positioned near a rearward focal point of the projection lens, wherein the shielding surface serves as a second reflector that reflects light from the first reflector toward the projection lens, and
a transparent portion formed on part of the second reflector such that part of the light reflected by the first reflector passes downward of the rearward focal point of the projection lens and is then incident to the projection lens.

6. The lamp unit of a vehicular headlamp according to claim 5,
wherein the shade is formed from a transparent material, and
wherein the shielding surface is formed by a surface treatment, and
wherein the transparent portion is formed by not being subjected to the surface treatment.

7. The lamp unit of a vehicular headlamp according to claim 6, wherein the surface treatment is metal vapor deposition.

8. The lamp unit of a vehicular headlamp according to claim 6,
wherein light passing through the transparent portion of the shade:
refracts when incident to the transparent material,
proceeds inside the transparent material,
radiates from a light radiation portion formed near the rearward focal point of the projection lens, and
is then incident to the projection lens.

9. The lamp unit of a vehicular headlamp according to claim 8, wherein the light radiation portion is positioned downward and rearward from the rearward focal point of the projection lens.

10. The lamp unit of a vehicular headlamp according to claim 5, wherein the light source is a semi-conductor light-emitting element.

11. A lamp unit of a vehicular headlamp comprising:

a projection lens with an optical axis;

a light source;

a first reflector that reflects light from the light source so as to collect such light on or near the optical axis; and a shade positioned between the light source and the projection lens so as to extend along a direction of the optical axis, wherein the shade:

shields part of the light reflected by the first reflector, serves as a second reflector that reflects light from the first reflector toward the projection lens, and the shade comprises a transparent portion that allows part of the light reflected by the first reflector to pass therethrough and downward of the rearward focal point of the projection lens and then incident to the projection lens.

12. The lamp unit of a vehicular headlamp according to claim 11, wherein the shade is formed from a transparent material, the shade comprising:

a shielding surface formed by a surface treatment formed thereon, and the transparent portion formed by not being subjected to the surface treatment.

13. The lamp unit of a vehicular headlamp according to claim 12, wherein the surface treatment is metal vapor deposition.

14. The lamp unit of a vehicular headlamp according to claim 12, wherein light passing through the transparent portion:

refracts and proceeds inside the transparent material of the shade, radiates from a light radiation portion formed near the rearward focal point of the projection lens, and is then incident to the projection lens.

15. The lamp unit of a vehicular headlamp according to claim 14, wherein the light radiation portion is positioned downward and rearward from the rearward focal point of the projection lens.

16. The lamp unit of a vehicular headlamp according to claim 1, wherein the light source is a semi-conductor light-emitting element.

* * * * *